US009929496B1

(12) United States Patent
Weiden et al.

(10) Patent No.: US 9,929,496 B1
(45) Date of Patent: Mar. 27, 2018

(54) RECTILINEAR COMMUNICATIONS CONNECTOR WITH SELECTABLE CABLE OUTLET POSITIONS FOR CONFINED SPACES

(71) Applicant: Schneider Electric USA, Inc., Andover, MA (US)

(72) Inventors: Conrad S Weiden, Chapel Hill, NC (US); Hien M Nguyen, Chapel Hill, NC (US); Michael Maloney, Raleigh, NC (US); Samuel Calloway, Lake Oswego, OR (US); Anthony Reac Arazo, Knightdale, NC (US)

(73) Assignee: Schneider Electric USA, Inc., Andover, MA (US)

( * ) Notice: Subject to any disclaimer, the term of this patent is extended or adjusted under 35 U.S.C. 154(b) by 0 days.

(21) Appl. No.: 15/385,010

(22) Filed: Dec. 20, 2016

(51) Int. Cl.
*H01R 13/58* (2006.01)
*H01R 24/64* (2011.01)
*H01R 107/00* (2006.01)

(52) U.S. Cl.
CPC ..... *H01R 13/5841* (2013.01); *H01R 24/64* (2013.01); *H01R 2107/00* (2013.01)

(58) Field of Classification Search
CPC . H01R 2107/00; H01R 24/64; H01R 13/5841
(Continued)

(56) References Cited

U.S. PATENT DOCUMENTS 3,747,049 A * 7/1973 Cressman ..... H01R 13/56 439/466
3,787,798 A * 1/1974 Carissimi ..... H01R 13/6335 439/466

(Continued)

FOREIGN PATENT DOCUMENTS

CN 202917787 U 5/2013

OTHER PUBLICATIONS

English Language Machine Translation of Chinese Patent Application Publication No. CN202917787U, Published on May 1, 2013, 4 pages.

*Primary Examiner* — Abdullah Riyami
*Assistant Examiner* — Nelson R Burgos-Guntin
(74) *Attorney, Agent, or Firm* — Locke Lord LLP

(57) ABSTRACT

A rectilinear communications connector configured for use in applications where space for exiting communications cables is extremely limited. The rectilinear communications connector of the present invention includes a base extending from an exit end of the connector and a cap attachable to the base. The base and cap defining a cavity in which an articulation section of the communications cable is enclosed and protected. The articulation section is a portion of the communications cable having a protective sheath covering the plurality of communications wires removed, thereby permitting the individual communication wires to be easily configured such that the communications cable exits the rectilinear communications connector at approximately 90 degrees with respect to the longitudinal axis of the communications connector. An originating end of the articulation section and a strain relief overmolded on the originating end are maintained in close contact with the base by the attached cap, thereby protecting and minimizing the articulation section exiting the rectilinear communications connector.

18 Claims, 5 Drawing Sheets

(58) Field of Classification Search
USPC ..... 439/472, 466, 468, 473, 694, 689, 685, 439/344, 676
See application file for complete search history.

(56) References Cited

U.S. PATENT DOCUMENTS

| | | | | |
|---|---|---|---|---|
| 4,127,316 | A * | 11/1978 | McKee | H01R 13/5808 439/468 |
| 4,195,899 | A * | 4/1980 | Radloff | H01R 13/5812 439/468 |
| 4,284,317 | A * | 8/1981 | Doyle | H01R 13/567 439/466 |
| 6,273,735 | B1 | 8/2001 | Johnson et al. | |
| 6,817,899 | B1 | 11/2004 | Zerebilov | |
| 6,910,904 | B2 * | 6/2005 | Herrick | F04B 39/121 439/271 |
| 6,962,504 | B2 * | 11/2005 | Fukui | H01R 13/567 439/466 |
| 6,991,467 | B1 | 1/2006 | Cheng et al. | |
| 7,131,858 | B1 | 11/2006 | Zerebilov | |
| 7,234,963 | B1 | 6/2007 | Huang | |
| 7,537,478 | B2 * | 5/2009 | Foltz | H02G 3/0487 439/466 |
| 8,801,456 | B2 * | 8/2014 | Miyakawa | H01R 13/111 439/466 |
| 2002/0055299 | A1 * | 5/2002 | Zweigle | H01R 13/5804 439/468 |
| 2003/0109169 | A1 * | 6/2003 | Ushiro | H01R 13/5816 439/468 |
| 2005/0003699 | A1 * | 1/2005 | Fukui | H01R 13/567 439/473 |

* cited by examiner

RECTILINEAR COMMUNICATIONS CONNECTOR WITH SELECTABLE CABLE OUTLET POSITIONS FOR CONFINED SPACES

FIELD OF THE INVENTION

The invention is generally directed communications cabling and particularly to rectilinear cable connectors for use in confined spaces.

BACKGROUND OF THE INVENTION

Most modern equipment requires the ability to communicate with controllers, other equipment, and humans to operate properly. Much of the communications is accomplished over wired networks that require a means to connect the equipment to the wired network. The current trend is a small rectilinear connector, such as an RJ45 type connector, which can be easily connected to and disconnected from the equipment. FIGS. 1A and 1B illustrate a state of the art rectilinear communications connector, generally represented as reference number 10. The rectilinear communications connector 10 includes an insulation displacement contact 14 for each communication wire 18 in the communications cable 22. The communication wires 18 can be arranged in twisted pairs and are enclosed in a protective sheath 26. The rectilinear communications connector 10 includes a strain relief 30 which clamps the protective sheath 26 and enclosed communications wires 18 of the communications cable 22 in the rectilinear communications connector 10 to prevent communications cable 22 pull out. The connector 10 also includes a latching means 34 that helps to prevent unintentional pull out of the connector 10 from a device to which it is connected. In densely packaged equipment, the installer must consider how the network cable is going to exit the connector. If the cable must be routed in a direction other than straight out of the connector the proper cable bend radius must be accounted for so as to prevent damage to the cable. The installer must either allow for this extra bending space or he must purchase a cable that has a special connector that permits the cable to exits at the proper angle and direction for the particular application. Allowing extra room for the cable bending space or buying a special cable can be cost prohibitive. Therefore, it would be desirable to have a communications cable with a connector that requires minimal space for the communications cable to exit the connector and which permits selectable directions at which the communications cable can exit the connector.

SUMMARY OF THE INVENTION

The present invention provides a rectilinear communications connector that can be used in situations where there is not sufficient room for the bend requirements of the communications cable and where the direction at which the communications cable exits the connector is selectable. The communications connector of the present invention permits the communications cable to exit the communications connector at approximately 90 degrees with respect to the longitudinal axis of the rectilinear communications connector and at one of several predetermined positions along the perimeter of the base.

Therefor, a rectilinear communications connector for use in confined spaces comprises:

a terminal end having terminals electrically connected to a plurality of communication wires of a communications cable;

an exit end providing an exit for the communication wires;

a base extending outwardly from and generally perpendicular to the exit end;

an articulating section permitting the plurality of communications wires to exit the communications connector at approximately 90 degrees with respect to a longitudinal axis of the communications connector;

a cap attachable to the base such that the cap retains the articulating section in its approximately 90 degree position with respect to the longitudinal axis of the communications connector, and; a strain relief overmolded onto the communications cable at an originating end of the articulation section.

DETAILED DESCRIPTION OF THE EMBODIMENTS

Figures 1A, 1B:
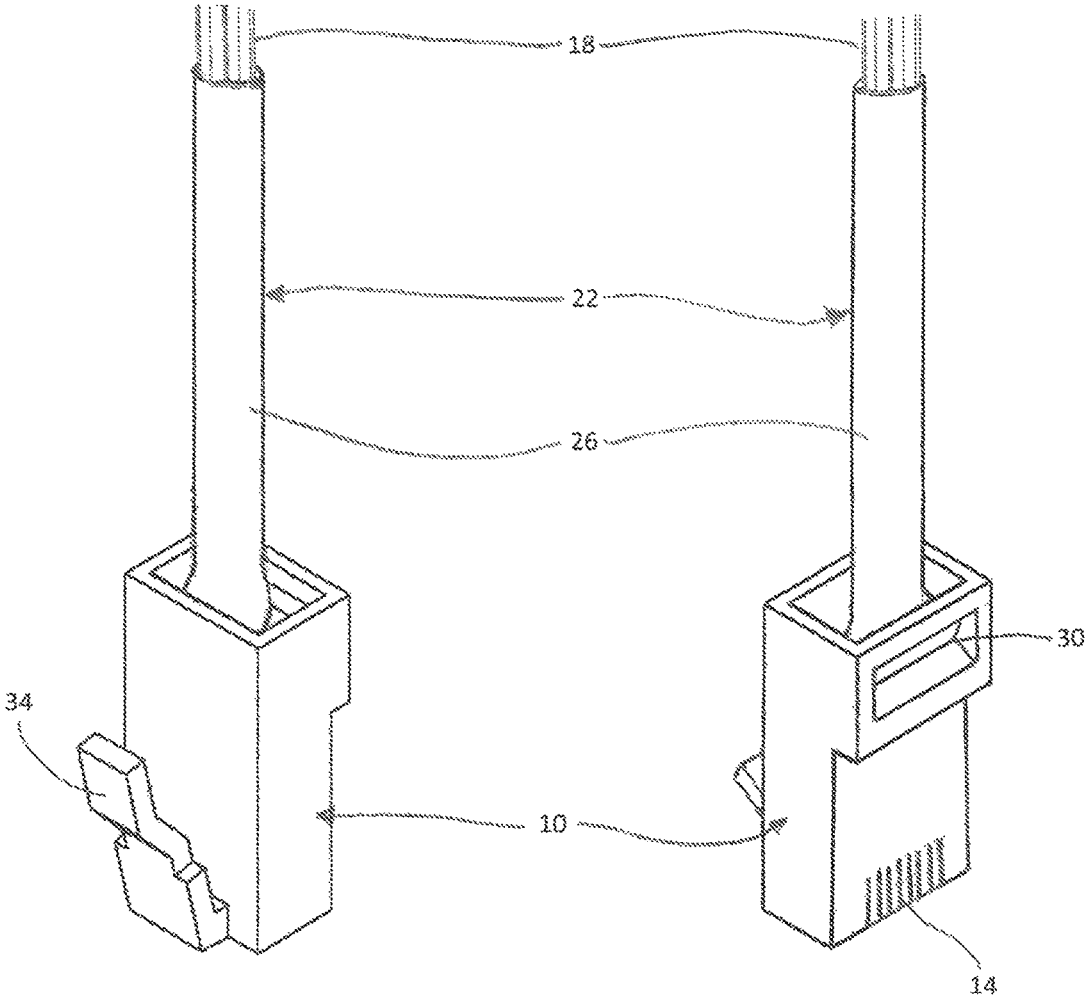
FIGS. 1A and 1B illustrate a state of the art rectilinear communications connector.
Figure 2:
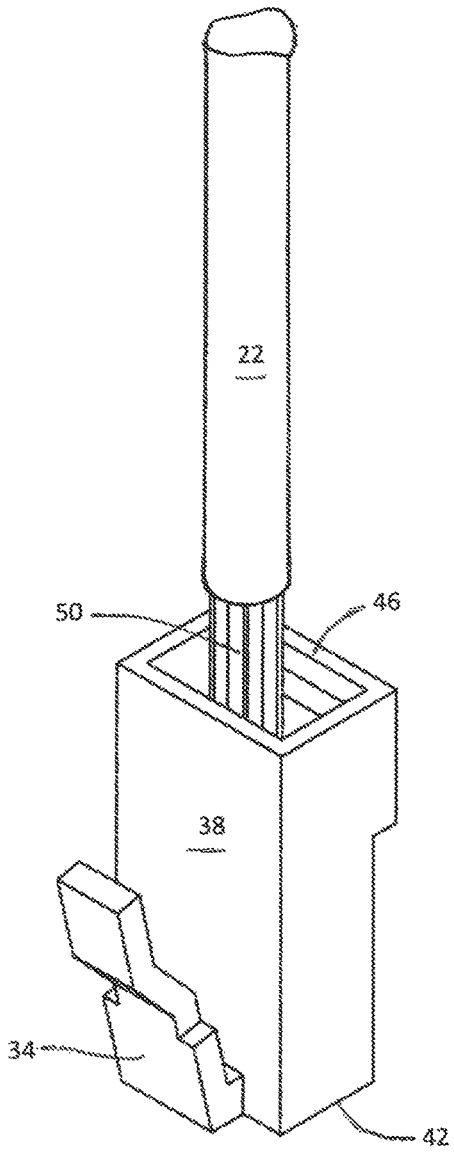
FIG. 2 illustrates a rectilinear communications connector configured in accordance with the present invention.
Figure 4:
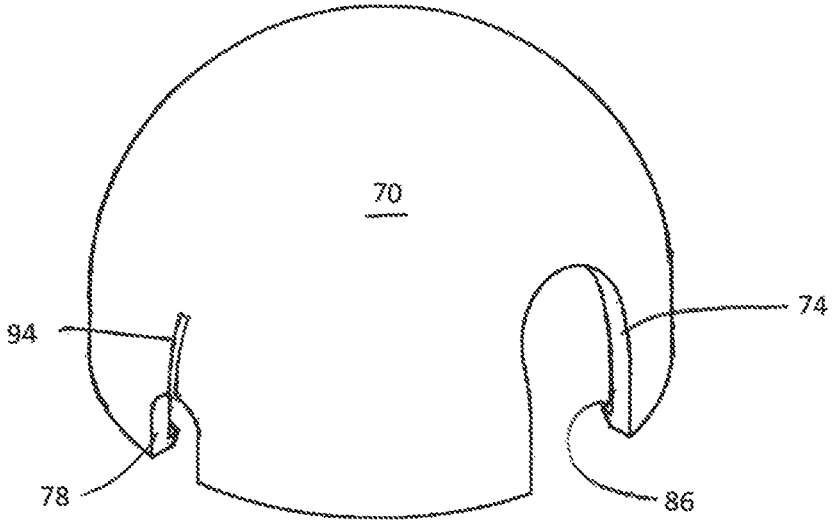
FIG. 4 illustrates an exploded view of a rectilinear connector of the present invention.
Figure 4:
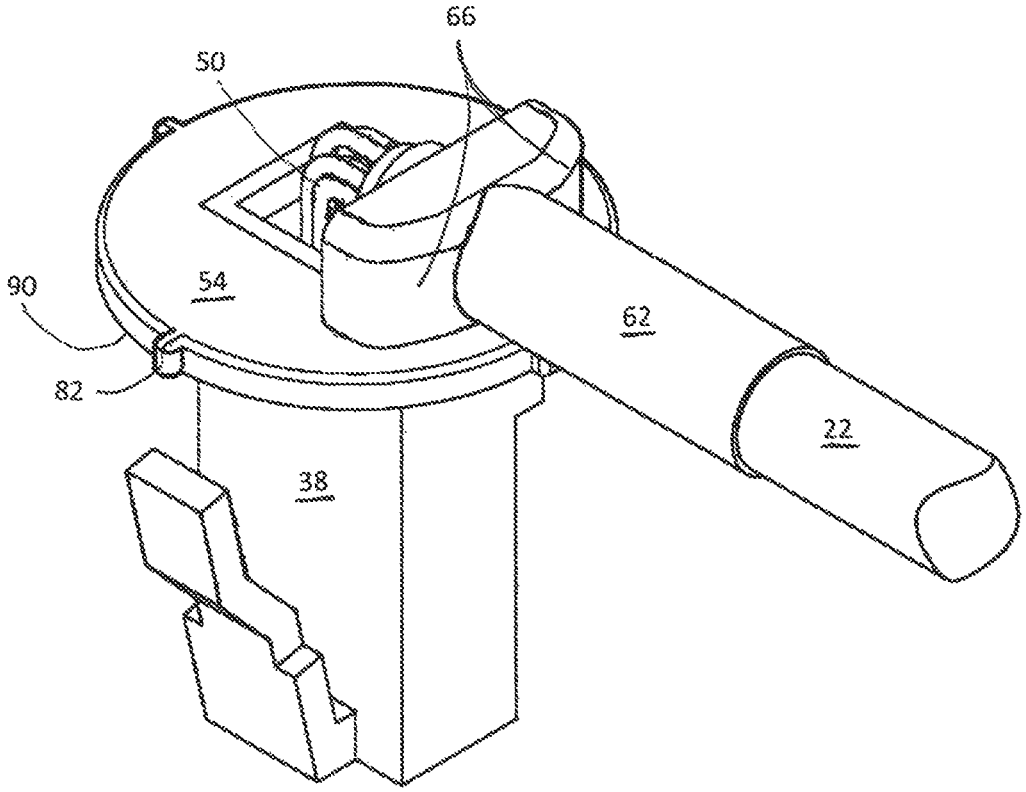

Referring now to FIG. 2, a rectilinear communications connector of the present invention, generally represented by reference number 38, is shown. The rectilinear communications connector 38 includes a terminal end 42, similar to the state of the art rectilinear communications connector 10, where insulation displacement contacts (not shown) are imbedded and a latching means 34 is located. At the exit end 46 of the communications connector 38 is an articulating section 50 comprising unsheathed wires 18 of communications cable 22 exiting the communications connector 38. Some communications cables 22 employ a foil shield (not shown) around the wires 18 to help prevent radio frequency interference from affecting communications over the wires 18. This shield can remain in place around the wires 18 in the articulating section 50. The unsheathed individual wires 18 of the articulation section 50 can be more easily bent to approximately 90 degrees with respect to the longitudinal axis of the rectilinear communications connector 38 and rotated about the longitudinal axis of the rectilinear communications connector 38 to a desired exit position as shown in FIG. 4. Distal ends of the articulation section 50 wires 18 are electrically connected to the insulation displacement contacts 14.

Figure 3:
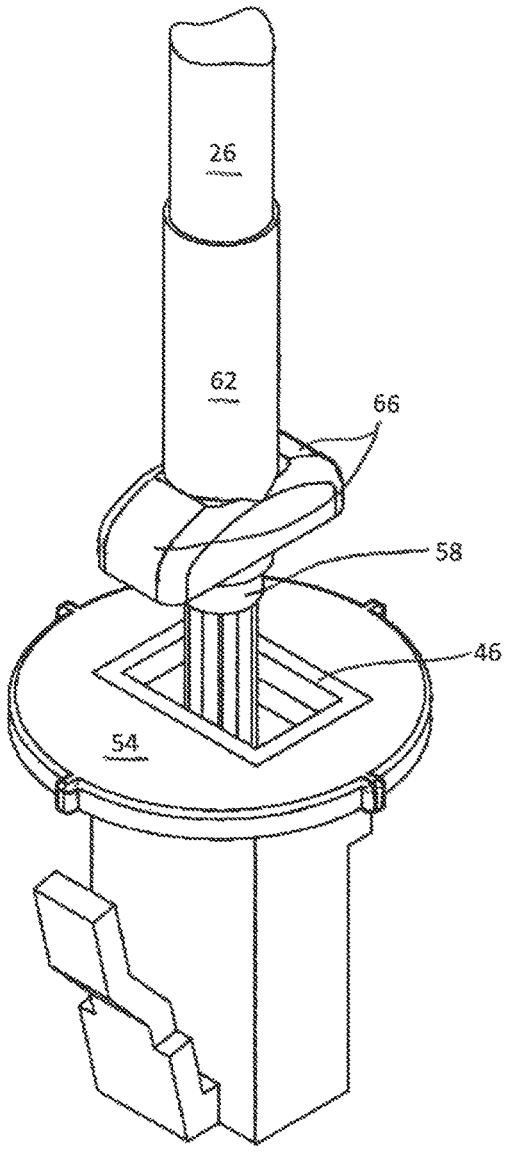
FIG. 3 illustrates the rectilinear communications connector and strain relief of the present invention.

Referring now to FIG. 3, an overmolded base 54 enclosing a short portion of the exit end 50 of communications connector 38 is shown. In this example, the base 54 is generally circular in shape and extends outward from and generally perpendicular to the perimeter of the exit end 46 of the communications connector 38. It is to be understood that the base 54 can be any actinomorphic (radially symmetric) shape. It is also understood that the communications connector 38 and base 54 can be molded as one integral component. At the originating end 58 of the articulation section 50, the communications cable 22 protective sheath 26 has an overmolded strain relief 62. The strain relief 62 conforms to the shape of the protective sheath 26 and has extending portions 66, which extend outwardly from and generally perpendicularly to the axis of the communications cable 22.

Figure 5:
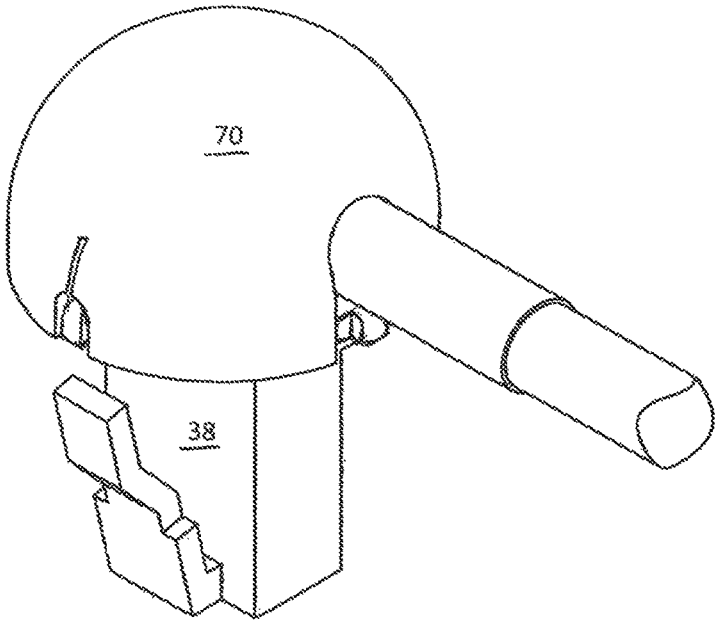
FIG. 5 illustrates an assembled rectilinear connector of the present invention.

FIG. 4 illustrates one example of the positions of the communications cable 22, articulating section 50, strain relief 62 and extending portions 66 with respect to the communications connector 38 and base 54 prior to attaching a cap 70. When installed, as shown in FIG. 5, the cap 70 maintains the cable in the approximately 90 degree position with respect to the longitudinal axis of the communications connector 38. The extending portions 66 of the strain relief 62 are configured to engage an inside surface of the cap 70 immediately adjacent a portal 74 through which the communications cable 22 exits, thereby preventing the wires 18 of the communications cable 22 from being pulled out of the communications connector 38. The cap 70 also includes alignment slots 78, which receive alignment nubs 82 extending outwardly form the perimeter of the base 54. The nubs 82 and slots 78 maintain the position of the cap 70 such that the portal 74 is in the desired exit position for the communications cable 22. When the cap 70 is fully installed on the base 54, an internally extending beveled latch 86 at the bottom of the cap 70 engages a bottom surface 90 of the base 54 to prevent unintentional removal of the cap 70. Narrow relief slots 94 extending upward from the alignment slots 78 permit sufficient flexing of portions of the cap 70 between alignment slots 78 to permit intentional removal of the cap 70 from the base 54.

Referring now to FIG. 5, when assembled, the base 54 and cap 70 define a cavity which encloses and protects the articulating section 50, secures the strain relief 62 and maintains the minimally extending articulating section 50 exiting from the communications connector 38 at approximately 90 degrees with respect to the longitudinal axis of the communications connector 38 and communications cable 22 exiting from the cap 70 at approximately 90 degrees with respect to the longitudinal axis of the communications connector 38 as shown in FIG. 4.

Figure 6:
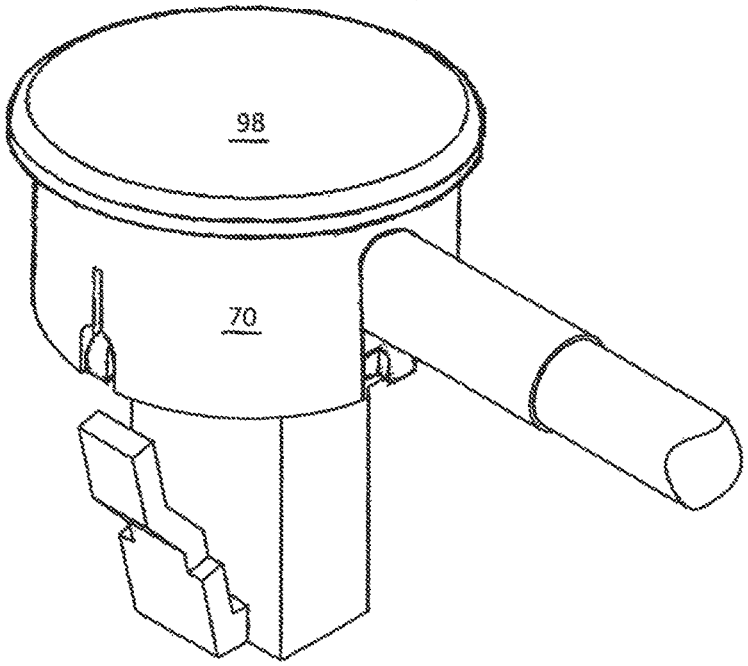
FIG. 6 illustrates an assembled rectilinear connector of the present invention with an alternate embodiment of the cap.

Referring now to FIG. 6, an alternate configuration of the cap 70 is shown. In this configuration the cap 70 is cylindrical in shape and has a generally flat top 98. Other features of the cap 70, base 54 and communications connector 38 remain as previously described.

Figure 7:
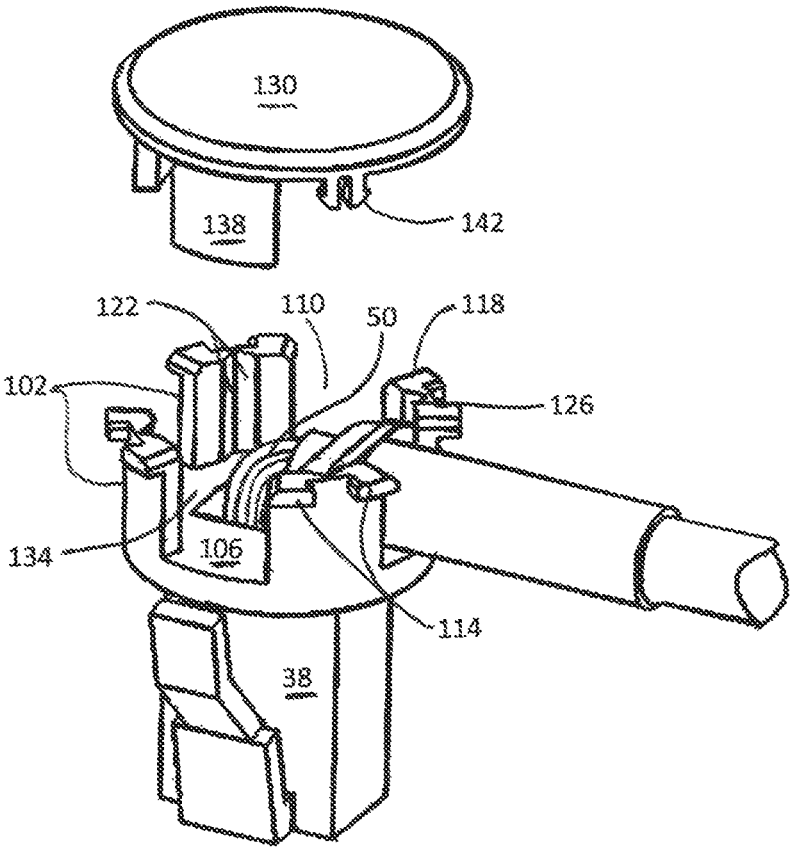
FIG. 7 illustrates an exploded view of an alternate embodiment of the rectilinear connector in accordance with the present invention.
Figure 8:
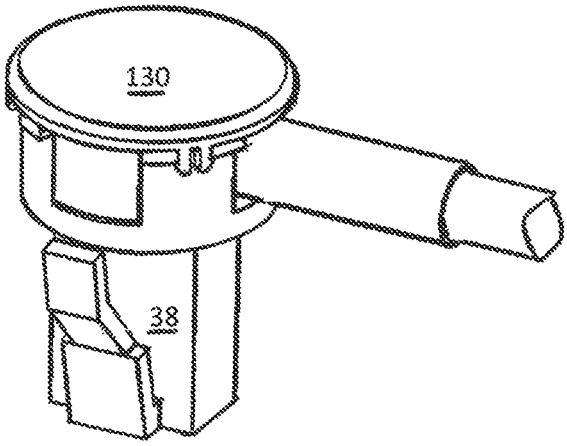
FIG. 8 illustrates an assembled alternate embodiment of the rectilinear connector in accordance with the present invention.

Referring now to FIG. 7, an alternate construction of the rectilinear connector 38 is shown. In this embodiment the communications connector 38, articulation section 50 and overmolded strain relief 62 remain the same as previously described. The overmolded base 54 is also configured generally as previously described except for an even number of columns 102, which extend outward from and generally perpendicular to a top surface 106 of the base 54. The columns 102 are uniformly spaced about the perimeter of the base such that a portal 110 is defined between adjacent columns 102, the portals 110 each being the same size. Each column 102 has a flange 114 at its distal end 118. The flanges 114 extend outward from and generally perpendicular to the columns 102 and are generally U-shaped. The inside surface of each column is configured such that two generally flat surfaces 122 extend between the top surface 106 of the base 54 and the distal end 118 of the column 102. The two generally flat surfaces 122 form a generally V-shaped groove 126. One portal 110 is selected as the desirable exit portal 110 for the communications cable 22. The articulating section 50 is rotated as required for the communications cable 22 to be slidably installed in the desired portal 110 with the strain relief 62 engaging the flat surfaces 122 adjacent the columns 102 defining the desired portal 110.

A cap 130 is provided to close a cavity 134 generally defined by the base 54 and columns 102. The cap 130 includes portal closures 138, extending downward generally perpendicularly from the perimeter of the cap 130 for closing the portals 110 and a latching means 142 that engage the outwardly extending U-shaped flanges 114 of columns 102. The cap 130 has one less portal closure 138 than the number of portals 110 defined by the columns 102 of the base 54. The cap 130 is installed such that the portal closures 138 close the portals 110 that were not selected as the desired portal 110 thereby permitting the communications cable 22 to exit through the desired portal 110.

We claim:

1. A rectilinear communications connector for use in confined spaces comprising:

a terminal end having terminals electrically connected to a plurality of communication wires of a communications cable;

an exit end providing an exit for the communication wires;

a base extending outwardly from and generally perpendicular to the exit end;

an articulating section permitting the plurality of communications wires to exit the communications connector at approximately 90 degrees with respect to a longitudinal axis of the communications connector;

a cap attachable to the base such that the cap retains the articulating section in its approximately 90 degree position with respect to the longitudinal axis of the communications connector, and;

a strain relief overmolded onto the communications cable at an originating end of the articulation section; wherein the originating end of the articulation section and the strain relief are maintained in close contact with the base by the attached cap, thereby protecting and minimizing the extended portion of the communication cable exiting the rectilinear communications connector in confined spaces.

2. The rectilinear communications connector of claim 1, wherein the base can be any actinomorphic shape.

3. The rectilinear communications connector of claim 1, wherein the base and attached cap define a cavity for enclosing and protecting the articulating section and a portal through which the communication cable exits the cavity.

4. The rectilinear communications connector of claim 3, wherein the cap can be positioned on the base such that the communications cable exits the cavity at one of several predetermined positions along a perimeter of the base.

5. The rectilinear communications connector of claim 4, wherein the predetermined positions are maintained by a number of alignment nubs extending from the perimeter of the base that are received in a number of alignment slots defined along a perimeter of the cap.

6. The rectilinear communications connector of claim 3, wherein the strain relief includes extending portions that engage an inside surface to the cavity adjacent the portal at which the communications cable exits the cavity preventing the communication cable from being pulled out of the rectilinear communications connector.

7. The rectilinear communications connector of claim 1, wherein the cap is attached to the base by an internally extending beveled latch at a bottom edge of the cap, which engages a bottom surface of the base.

8. The rectilinear communications connector of claim 1, wherein the base can include a plurality of columns extending outwardly from and generally perpendicular to the base such that they are parallel to the linear axis of the rectilinear communications connector, a portal is defined between adjacent columns through which the communications cable can exit.

9. The rectilinear communications connector of claim 8, wherein plurality of columns is an even number of columns.

10. The rectilinear communications connector of claim 8, wherein the cap is generally flat and includes portal closures extending downward from a perimeter of the cap such that the portal closures close all but one of the portals defined by the columns and thereby generally define a cavity for enclosing and protecting the articulating section, the communications cable exiting the cavity through the open portal.

11. The rectilinear communications connector of claim 10, wherein the cap includes means for attaching to a distal end of the columns.

12. The rectilinear communications connector of claim 8, wherein the strain relief includes extending portions that engage an inside surface the columns adjacent the portal at which the communications cable exits the cavity preventing the communication cable from being pulled out of the rectilinear communications connector.

13. The rectilinear communications connector of claim 1, wherein the articulating section is a portion of the communications cable having a protective sheath covering the plurality of communications wires removed, thereby permitting the individual communication wires to be easily configured such that the communications cable exits the rectilinear communications connector at approximately 90 degrees with respect to the longitudinal axis of the communications connector.

14. A rectilinear communications connector for use in confined spaces comprising:

a terminal end having terminals electrically connected to a plurality of communication wires of a communications cable;

an exit end from which the communication wires exit the rectilinear communications connector;

a base extending outwardly from and generally perpendicular to the exit end;

an articulating section permitting the plurality of communications wires to exit the communications connector at approximately 90 degrees with respect to a longitudinal axis of the rectilinear communications connector, thereby significantly reducing a required communications cable bend radius;

a strain relief overmolded onto the communications cable at an originating end of the articulation section, and;

a cap, attachable to the base such that a cavity and a portal are defined, the cavity enclosing and protecting the articulating section and the portal providing an exit for the communication cable;

wherein the originating end of the articulation section and the strain relief are maintained in close contact with the base by the attached cap, thereby protecting and minimizing the extended portion of the communication cable exiting the rectilinear communications connector in confined spaces.

15. The rectilinear communications connector of claim 14, wherein the base can be any actinomorphic shape.

16. The rectilinear communications connector of claim 14, wherein the cap can be positioned on the base such that the communications cable exits the cavity at one of several predetermined positions along a perimeter of the base.

17. The rectilinear communications connector of claim 14, wherein the strain relief includes extending portions that engage an inside surface to the cavity adjacent the portal at which the communications cable exits the cavity preventing the communication cable from being pulled out of the rectilinear communications connector.

18. The rectilinear communications connector of claim 14, wherein the articulating section is a portion of the communications cable having a protective sheath covering the plurality of communications wires removed, thereby permitting the individual communication wires to be easily configured such that the communications cable exits the rectilinear communications connector at approximately 90 degrees with respect to the longitudinal axis of the communications connector.

* * * * *